US005378864A

United States Patent [19]

Olivier et al.

[11] Patent Number: 5,378,864

[45] Date of Patent: Jan. 3, 1995

[54] NON-RESETTABLE, PRESSURE-ACTUATED SWITCH

[75] Inventors: André W. Olivier, New Orleans; Oneil J. Williams, Jr., Metairie, both of La.

[73] Assignee: The Laitram Corporation, Harahan, La.

[21] Appl. No.: 74,056

[22] Filed: Jun. 9, 1993

[51] Int. Cl.[6] ..... H01H 39/00

[52] U.S. Cl. ..... 200/61.08; 137/68.1; 200/83 P; 340/652

[58] Field of Search ..... 307/118; 340/611, 626, 340/652; 137/68.1, 557; 116/266, 268, 272; 200/61.08, 831 R, 831 A, 831 J, 831 P

[56] References Cited

U.S. PATENT DOCUMENTS

| | | | |
|---|---|---|---|
| 4,107,672 | 8/1978 | Riemsdijk | 340/605 |
| 4,178,855 | 12/1979 | McVay | 200/61.08 |
| 4,342,988 | 8/1982 | Thompson | 340/679 |
| 4,698,623 | 10/1987 | Smith | 340/665 |
| 4,827,094 | 5/1989 | Tanaka et al. | 200/83 J |
| 4,948,931 | 8/1990 | Nixon et al. | 200/83 P |
| 4,965,415 | 10/1990 | Young et al. | 200/83 N |
| 4,978,947 | 12/1990 | Finnegan | 340/611 |
| 4,982,664 | 1/1991 | Norton | 102/272 |
| 5,155,471 | 10/1992 | Ellis | 200/61.08 |

FOREIGN PATENT DOCUMENTS

| | | | |
|---|---|---|---|
| 915540 | 1/1963 | United Kingdom | 200/61.08 |
| 1171951 | 11/1969 | United Kingdom | 200/61.08 |

*Primary Examiner*—Gerald P. Tolin
*Attorney, Agent, or Firm*—James T. Cronvich

[57] ABSTRACT

A general-purpose, pressure-sensitive electrical switch, having a frangible electrically conductive path that is irreversibly broken by an excessive applied pressure differential, The switch includes a pressure-deflectable diaphragm and an interior chamber. The diaphragm forms an interface between the internal chamber and the external environment. As the pressure differential across the diaphragm exceeds a specified level, the diaphragm deflects. The internal chamber can also be sealed with an internal pressure $P_1$ so that the diaphragm deflects for a specified absolute external pressure $P_2$. The force of the deflection is transmitted to brittle, inelastic structure within the switch through an intermediate load transmission element. The electrical path, which is along the brittle structure, terminates in a pair of externally-accessible terminals. The force of deflection stresses the brittle structure beyond its fracture stress level, causing it to break and opening the electrical path between the terminals. A ceramic bar traversing the switch through the sealed chamber or the base itself can serve as the frangible structure. The electrical terminals can be connected into an external alarm circuit for positive indication of the occurrence of a preselected pressure condition.

31 Claims, 5 Drawing Sheets

NON-RESETTABLE, PRESSURE-ACTUATED SWITCH

BACKGROUND

This invention relates to electrical switches and, more particularly, to non-resettable, pressure-actuated electrical switches having a pressure-sensitive diaphragm and a frangible conductive path that can be irreversibly broken by forces resulting from the pressure-actuated deflection of the diaphragm.

Electrical switches having a pressure-sensitive diaphragm that deflects in response to an applied pressure differential to open or close electrical contacts are used in the monitoring and control of fluid systems. A micro-engineered electrical switch that makes or breaks an electrical contact when the pressure differential across a domed snap-action diaphragm exceeds a certain level is disclosed in U.S. Pat. No. 4,965,415. As the pressure differential decreases, the diaphragm snaps back to its original position, thereby resetting the electrical contacts to their prior make or break condition.

There are, however, situations in which it is undesirable to have the switch reset itself. Certain depth- or pressure-sensitive instrumentation experience a reduction in performance or accuracy as a result of exposure to depths or pressures beyond design limits. The resulting reduction in performance is often subtle and not easily discernible by the user. In some cases, equipment damage could result from such misuse. In such situations, it is often important that uncontrovertible, non-resettable evidence of misuse be available.

There are other situations in which a resettable switch is not desirable. U.S. government regulations covering the export of high technology require that certain electronic devices not operate outside of specified operating limits. In the case of highly accurate digital heading sensors deployed on submarine-towed sonar arrays, government regulations require that sensors sold to certain foreign countries fail once they are used below a specified depth. Such a hard failure is undesirably correctable with a resettable device.

Non-resettable, flow-actuated devices are used to indicate the safety relief of overpressure in fluid flow applications. In U.S. Pat. No. 4,978,947, a rupturable fluid flow indicator is disclosed. The indicator includes an electrical path traversing a weakened portion of a rupturable perforated disk clamped across a fluid flow passageway. When the pressure differential across a related pressure-sensitive safety membrane connected across the passageway between the disk and the fluid exceeds a specified level, the membrane ruptures, thereby diverting some of the fluid into the passageway. The flow pressure of the diverted fluid exerted on the disk causes it to rupture, breaking the electrical path, which can set off an alarm. Although the fluid flow indicator is not resettable and operator intervention is required to replace it, the device relies on fluid flow to break the electrical path. Thus, a passageway for the fluid to flow in must be provided. Furthermore, the perforations in the disk reference the pressure differential to the pressure existing in the passageway, typically atmospheric. The pressure-sensitive membrane, moreover, ruptures only if the external pressure exerted by the fluid is too high; it is not designed to operate when the external pressure is low. The usefulness of the indicator is limited to pipeline fluid flow applications; it is not a self-contained unit with general utility.

For the foregoing reasons, there is a need for a simple, self-contained, general-purpose, pressure-sensitive device to irreversibly break an electrical path when the applied pressure exceeds a specified level.

SUMMARY

A novel non-resettable, pressure activated electrical switch, which satisfies this need is provided. The switch includes a base with a frangible conducting means traversing the base. A pressure-sensitive diaphragm is attached along its edge to one side of the base forming a chamber. When the pressure differential between the chamber and the exterior of the diaphragm exceeds a specified amount, the deflection of the diaphragm transmits a force sufficient to irreversibly break the conducting means and permanently open the electrical path.

In one embodiment of the switch, the base is a disk of brittle material having a weakened or thin region. A strip of conductive material deposited on the disk and intersecting the weakened region forms a continuous electrical path terminated in a pair of externally-accessible electrical terminals. A domed diaphragm is sealed along its edge to the base. Whenever the external pressure exceeds the internal pressure by a specified amount, the diaphragm instantaneously deflects and snaps the brittle base along its thin region, severing the conducting strip and opening the electrical path.

In another embodiment of the switch, the base includes sidewalls forming a hollow vessel open at one end. A pressure-sensitive diaphragm is sealed at its edge over the open end to form a sealed chamber at a certain internal pressure. An inelastic rod, cantilevered across the sealed chamber, extends through holes in the sidewalls on opposite sides of the chamber. The rod includes a conductive path along its length terminated in a pair of externally-accessible electrical terminals extending out from the sidewalls. A load transmission element, such as a piston, is positioned in the chamber between the rod and the diaphragm. Deflection of the diaphragm as the external pressure exceeds the internal pressure by more than a specified amount imparts a motive force transmitted by the piston as a transverse load to the rod sufficient to snap the inelastic rod and open the conductive path. A tapered projection extending from the piston is used to concentrate the transverse load to stress the rod beyond its fracture stress.

A ring, or doughnut, surrounding the midportion of the rod can also be used to transmit the deflection force to the rod. In a version of the switch designed to actuate at an external pressure greater than the internal pressure, the domed portion of a snap-action diaphragm bulges outward of the chamber. When the external pressure exceeds a specified level, the diaphragm instantaneously deflects inwardly, contacting the ring, which snaps the rod. In a version designed to actuate at an external pressure less than the internal pressure, the domed portion is normally bulging into the chamber. The ring is attached to the diaphragm, so that, when the diaphragm snaps outward at the specified external pressure, the ring is pulled along with it, snapping the brittle rod.

The pressure differential required to actuate the diaphragm is set by its thickness and geometry. With an unsealed internal chamber, the switch actuates at the specified pressure differential. With the internal chamber of the switch sealed, the internal pressure can be set during manufacture. Thus, the pressure reference need not be standard atmospheric pressure as in most pressure-actuated switches, and the switch actuates at a specified absolute external pressure.

The diaphragm can be either a domed snap-action diaphragm for instantaneous, non-linear deflection or a flat diaphragm for linear deflection with pressure. The simple electrical path includes no electronic devices, but merely requires connection at the terminals, such as through a constantly monitored external alarm circuit or through a continuity checker. With few parts, the switch is inexpensive to manufacture as a disposable device.

With its sealed construction and its simple electrical connections, the switch is a self-contained, general-purpose electrical interruption device adaptable to many applications.

DRAWINGS

These and other features, aspects, and advantages of the present invention will become better understood with reference to the following description, appended claims, and accompanying drawings in which:

DESCRIPTION

Figure 1:
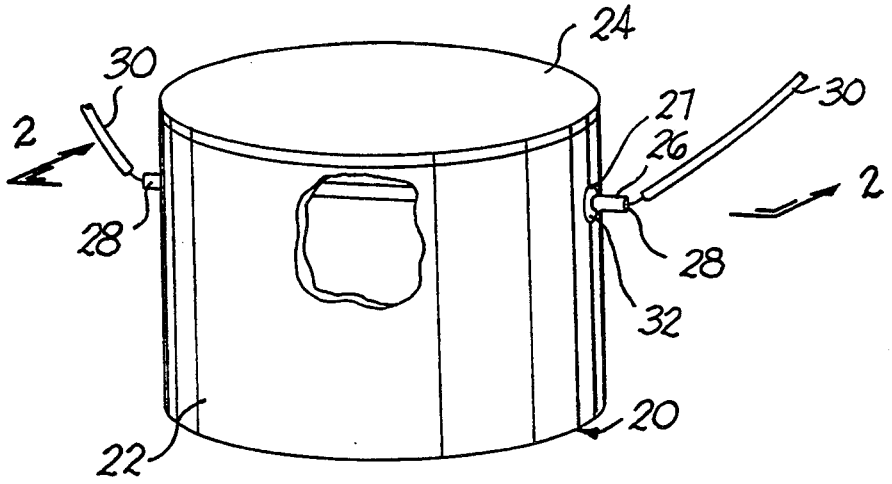
FIG. 1 is an oblique partially broken away elevational perspective view of a preferred embodiment of the electrical switch of the invention.

One embodiment of the electrical switch of the invention is shown in FIG. 1. The switch 20 includes a base 22 forming a hollow vessel covered at an open end by a diaphragm 24 sealed along its edge to the base 22. A rod, or tube, 26 extends through holes 27 in the base 22 and forms a pair of electrical terminals 28 at the ends of the rod 26. The terminals 28 provide external access to electrical connections, such as soldered wires 30. The rod 26, which includes a conductive path, is held in place in the holes 27 by an epoxy potting compound 32 or the like. The vessel 22 can be made of metal, but a strong and lightweight non-metallic material, such as a reinforced epoxy resin-based composite, is preferred. For use with magnetic heading sensors, a non-magnetic material is especially critical.

Figure 2A:
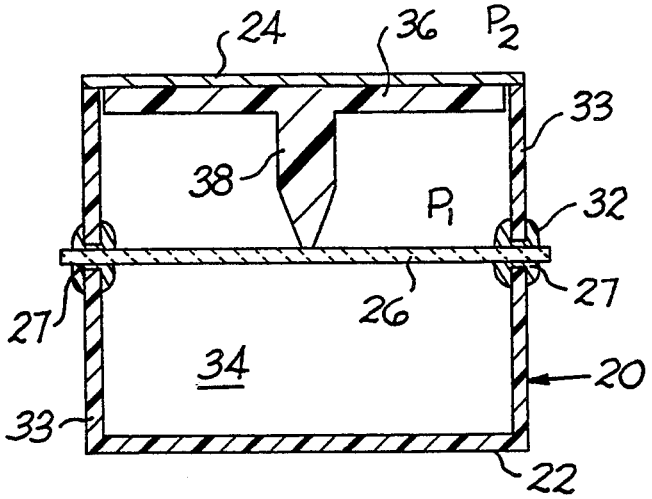
FIGS. 2A and 2B are cross-sectional elevational views of one version of the embodiment of the switch of FIG. 1 at line 2—2, illustrating, respectively, the switch before and after the opening of the electrical path.

A cross-section of one version of the switch 20 is shown in FIG. 2A. The base 22 includes sidewall structure 33 having a pair of opposing holes 27 therethrough. The rod 26 is cantilevered across a chamber 34 sealed by the diaphragm 24 and the potting compound 32 affixing the rod 26 in the holes 27.

Figure 5A:
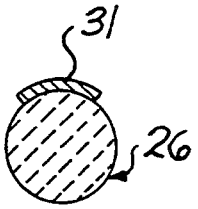
FIG. 5A is a cross-sectional view of the rod of FIGS. 1–4, comprising a ceramic rod with a conductive layer deposited thereupon.
Figure 5B:
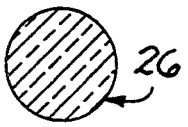
FIG. 5B is a cross-sectional view of the rod of FIGS. 1–4, comprising a conductive metallized ceramic rod.

As shown in FIG. 5A, the rod 26 is preferably made of a brittle inelastic material, such as a ceramic. A layer 31 of conductive material, such as gold, deposited along the length of the rod 25 forms a continuous electrical path. Alternatively, as shown in FIG. 5B, the rod 26 can be made of a metallized ceramic material impregnated with metal particles to form the conductive path.

Figure 2B:
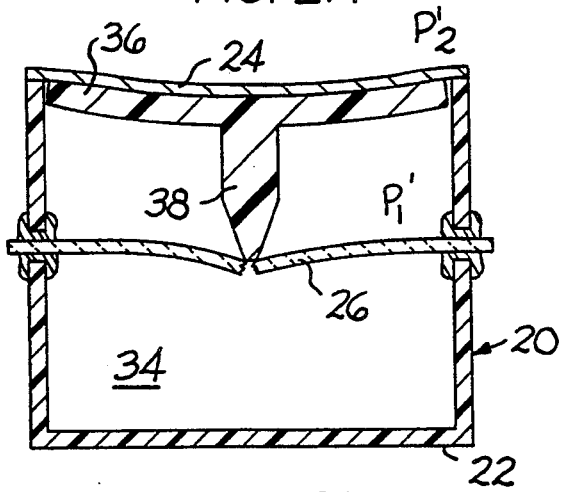

A piston 36 attached to the interior side of the diaphragm 24 includes a tapered extension 38, the narrow end of which contacts the rod 26. The piston 36 is preferably made of a lightweight metal or plastic having low inertia to prevent inadvertent tripping of the switch with shock or vibration. The pressure $P_1$, inside the sealed chamber 34 is set when the switch 20 is manufactured by, for example, assembling the switch in an atmosphere at an ambient pressure $P_1$. When the external pressure $P_2$ and the sealed-in internal pressure $P_1$ are about the same, i.e., the pressure differential across the diaphragm 26 is small, the deflection of the diaphragm 26 is minimal as shown in FIG. 2A. As the external pressure $P_2$ increases as shown in FIG. 2B, the pressure-sensitive diaphragm 26 deflects into the chamber 34. The force of deflection is transmitted through the piston 36, and a transverse load is concentrated on the brittle rod 26 by the tapered extension 38. At a certain external pressure level $P'_2$, the force of deflection causes the piston 36 to stress the rod 26 beyond its fracture stress, at which level the rod 26 snaps, opening the conductive path along its length. The diaphragm 24 can be made of a metal foil, rubber, or some other elastic material.

Figure 3A:
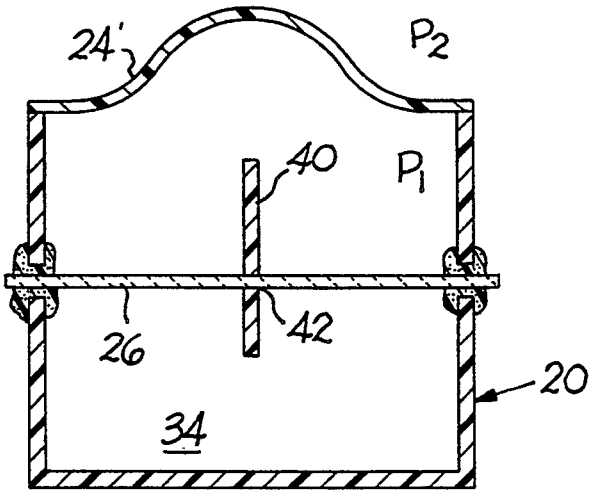
FIGS. 3A and 3B are cross-sectional elevational views as in FIGS. 2A and 2B of another version of the switch of FIG. 1.
Figure 3B:
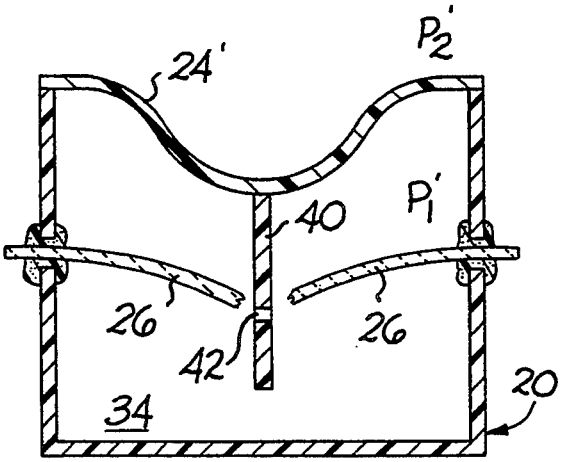

Another version of the switch of FIG. 1, as shown in FIGS. 3A and 3B, replaces the linear-deflecting diaphragm 24 of FIGS. 2A and 2B with a domed, snap-action diaphragm 24' formed of metal or plastic. Furthermore, the load transmission element is a ring, or doughnut, 40, instead of the piston 36 of FIGS. 2A and 2B. The ring 40 has a central bore 42 through which the brittle rod 26 is attached. When the pressure differential $(P_2-P_1)$ is below the snap pressure level, the domed portion of the diaphragm 24' extends outwardly of the sealed chamber 34, as shown in FIG. 3A. When the external pressure increases to a level $P'_2$ such that the pressure differential across the diaphragm 24' is greater than the snap level, the domed portion of the diaphragm 24' suddenly deflects into the chamber 34, as shown in FIG. 3B. The deflected diaphragm 24' contacts the ring 40, which snaps the rod 26, breaking the electrical path.

Figure 4A:
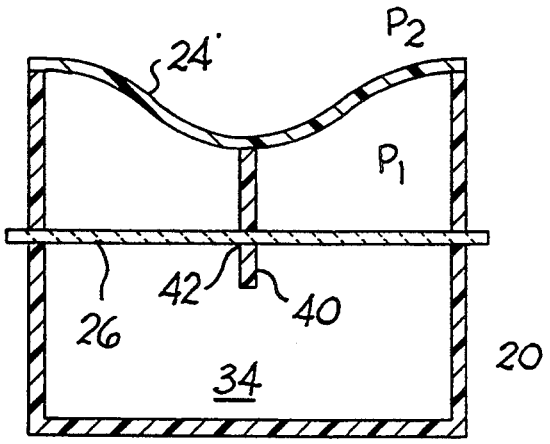
FIGS. 4A and 4B are cross-sectional elevational views as in FIGS. 3A and 3B of a version of the switch of FIG. 1, in which the switch actuates at an external pressure lower than the internal pressure.
Figure 4B:
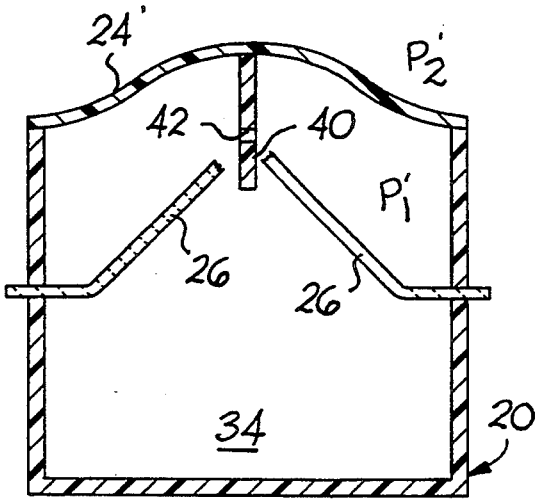

The switch 20 can also be made to operate for pressure differentials in which the external pressure drops below the internal pressure by more than a specified amount. As shown in FIG. 4A, the ring 40 surrounding the rod 26 is attached along a section of its perimeter to the interior side of the inwardly deflected diaphragm 24'. As soon as the external pressure $P_2$ drops below the snap pressure level $P'_2$, the diaphragm 24' deflects by snap action outward from the chamber 34. The ring 40 attached to and pulled along with the diaphragm 24' snaps the brittle rod 26.

Figure 6A:
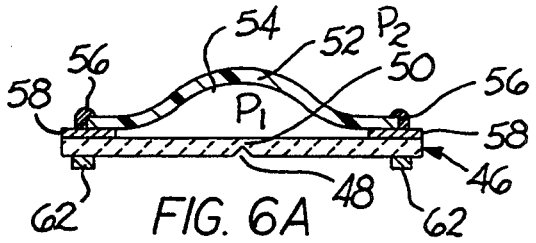
FIGS. 6A and 6B are cross-sectional elevational views of another embodiment of the switch of the invention, illustrating, respectively, the switch before and after actuation.
Figure 6B:
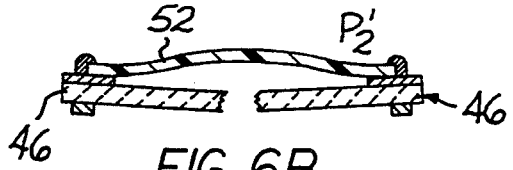
Figure 6C:
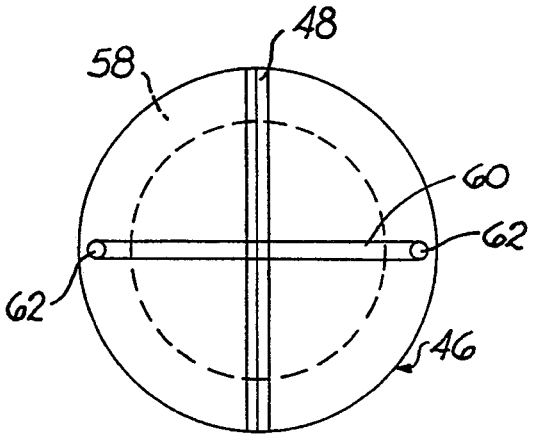
FIG. 6C is a bottom view of the switch of FIG. 6A.

Another embodiment of the switch is shown in FIGS. 6 and 7. The switch includes a brittle base 46 such as a ceramic substrate scored with a groove 48 to form a weaker, thin region 50 across the base 46. A domed, snap-action diaphragm 52 is sealed to the base 46 enclosing a sealed chamber 54 at an internal pressure $P_1$. The diaphragm is sealed along its outer edge to the base 46 by a soldered connection 56 to a metal layer 58 on the base 46. A layer of conductive material in the form of a strip 60 is deposited on the base 46 to form a continuous electrical path across the base 46 terminating in a pair of externally-accessible terminals 62. As soon as the external pressure $P_2$ exceeds the internal pressure $P_1$ by the snap pressure level, the diaphragm 52 instantaneously deflects toward the sealed chamber 54. The deflection force is transmitted to the base 46 through the soldered connection 56, stressing the inelastic base 46 in the thin region 50 sufficient to cause it to snap. The conductive strip 60 which crosses the thin region 50 is thereby severed and the electrical path permanently opened.

Figure 7A:
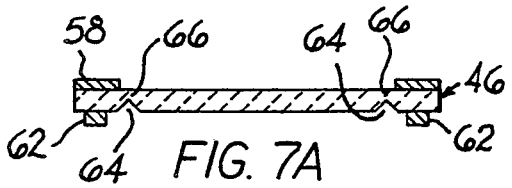
FIG. 7A is a cross-sectional elevational view of another version of the base of the switch in FIG. 6A.
Figure 7B:
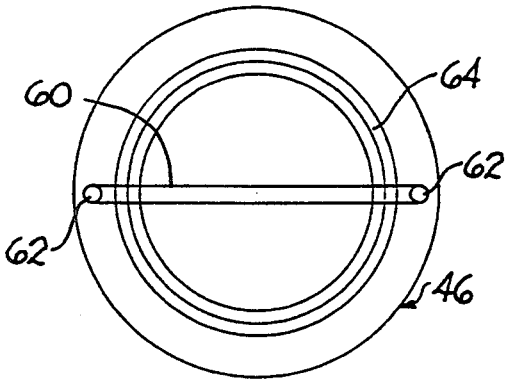
FIG. 7B is a bottom view of the base of FIG. 7A.

Another version of the base of the switch is shown in FIGS. 7A and 7B, in which the base 46 is scored with a concentric circular groove 64 forming a circumferential thin region 66 intersected by the conductive strip 60.

Figure 8:
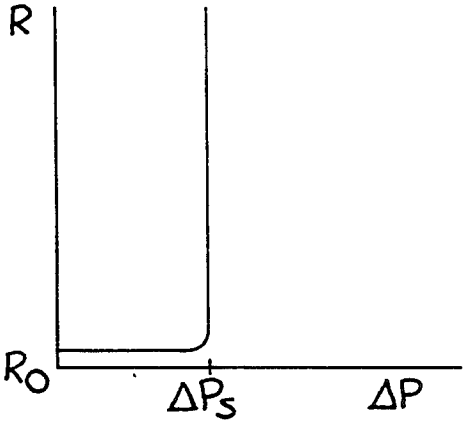
FIG. 8 is a plot of terminal-to-terminal resistance of a snap-action switch in accordance with the invention as a function of the applied pressure differential.

As shown in FIG. 8, the snap-action diaphragm switches exhibit a non-linear resistance versus pressure differential relationship. As long as the differential pressure across the diaphragm is less than the snap level pressure differential $\Delta P_s$, the resistance of the electrical path across the switch is $R_o$, typically less than 1 ohm. As soon as the differential pressure exceeds the snap level $\Delta P_s$, the frangible electrical path is positively, suddenly, and irreversibly broken, resulting in an open circuit across the disk. The snap level pressure differential $\Delta P_s$ can be set by the thickness of the diaphragm, for instance.

Because the previously described versions of the invention offer many advantages, including non-resettability simple construction, simple electrical connectivity, and flexibility in setting a reference pressure, it has many applications.

Figure 9:
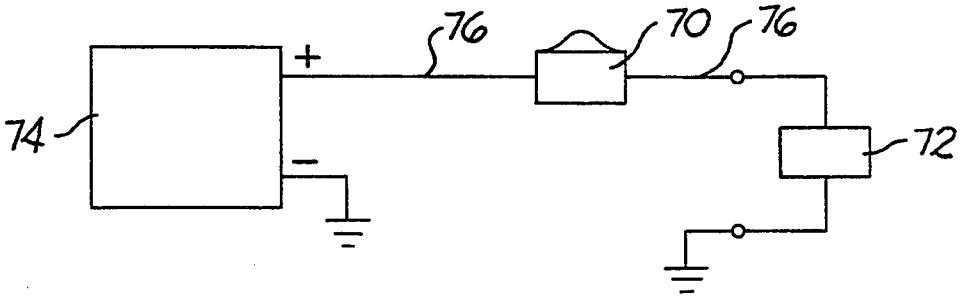
FIG. 9 is an electrical schematic of a circuit using the switch of the invention.

A typical electrical connection of the switch is shown schematically in FIG. 9. The switch 70 is connected in series in the power line 76 of an externally powered device 74 between the device and an external power source 72. At the preset pressure level, the switch 70 actuates and opens the power line 76, disabling the device 74.

Figure 10:
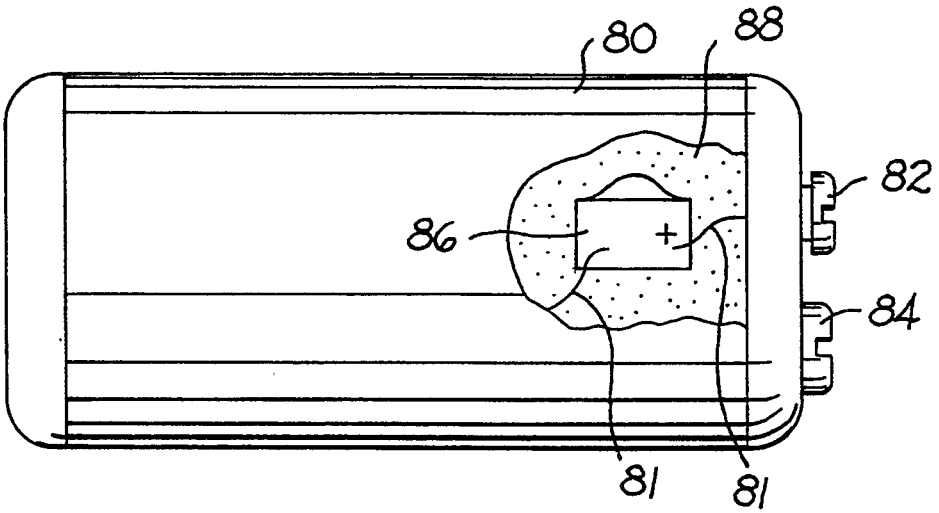
FIG. 10 is a partially cut-away elevational view of an application for the switch of the invention in a heading sensor.

FIG. 10 shows a digital heading sensor 80, such as the Model 315 manufactured by DigiCOURSE, Inc. of Harahan, La. Such heading sensors are frequently used in submarine-towed sonar arrays. In some cases, it is desirable for the heading sensor 80 to stop operating once it is deployed below a specified depth. Outfitted with the non-resettable, snap-action switch 86 of the invention, the heading sensor 80 can be made to conform to the specified condition. As shown, the heading sensor 80 has two power terminals 82, 84 providing access to an external power source (not shown). The switch 86 is connected in series with one of the power terminals, in this case terminal 82 through conductors 81. The switch resides inside the heading sensor 80, which is filled with a damping fluid 88 for the heading sensing mechanism. As the heading sensor 80 is deployed below the specified depth, the pressure outside the heading sensor increases and compresses the heading sensor so that the pressure within the heading sensor rises to a level sufficient to cause the switch 86 to operate and open the power circuit, thereby disabling the heading sensor as required.

Figure 11:
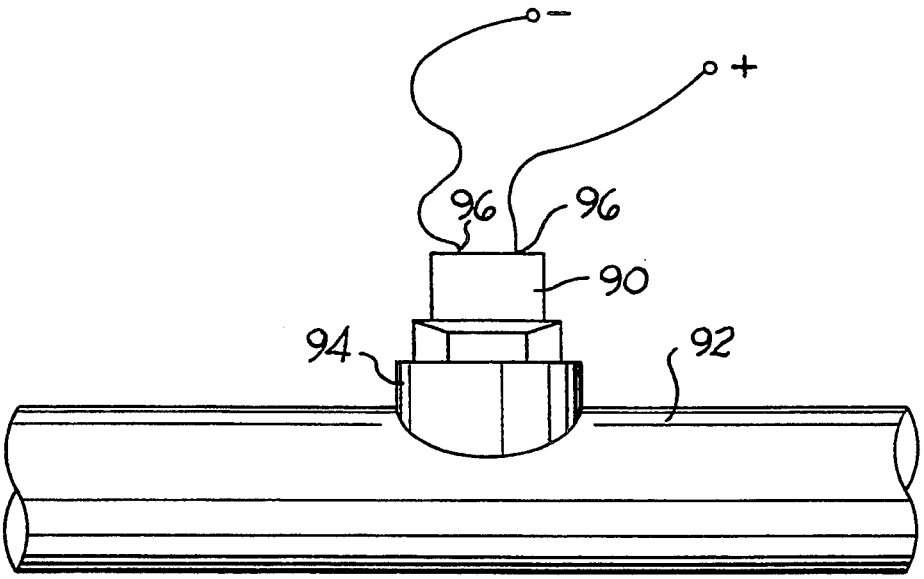
FIG. 11 is an elevational view of the switch of the invention used to monitor fluid pressure in a pipe.

Another application is shown in FIG. 11, in which the switch 90 is mounted to a pipeline 92 through an access port 94. The terminals 96 of the switch 90 can be connected, for example, into an alarm circuit (not shown) so that as soon as the fluid flow pressure exceeds a specified level, or drops below a specified level, the switch 90 actuates, opening its electrical path, thereby sounding the alarm.

Although the invention has been described in considerable detail with reference to certain preferred versions thereof, other versions are possible. Therefore, the spirit and scope of the appended claims should not be limited to the description of the preferred versions contained herein.

What is claimed is:

1. A non-resettable, pressure-actuated electrical switch, comprising:
   - a base;
   - frangible conducting means including a continuous electrical path traversing the base;
   - a diaphragm attached along an edge to the base to form a chamber between the diaphragm and the base, the diaphragm having an exterior side and an interior side bordering the chamber, said chamber being closed to the atmosphere; and
   - a force transmission element physically coupled to the interior side of the diaphragm;
   - the diaphragm responding to a preselected pressure differential across the diaphragm by deflecting and imparting a deflection force to the force transmission element to break the frangible conducting means and cause the electrical path to open irreversibly.

2. The switch of claim 1, wherein the base is frangible and the conducting means comprises a strip of conductive material deposited on the base to form the continuous electrical path.

3. The switch of claim 2, wherein the base includes a thin region and wherein the strip of conductive material intersects the thin region.

4. The switch of claim 2, wherein the force transmission element comprises a sealed connection between the base and the edge of the diaphragm.

5. The switch of claim 2, wherein the base comprises a disk made of a brittle material, the disk having a groove along a first diametrical direction and wherein the strip of conductive material is deposited on the disk along a second diametrical direction.

6. The switch of claim 1, wherein the base comprises sidewall structure bordering the chamber and wherein the frangible conducting means comprises a rod having a deposit of conductive material therealong forming the continuous electrical path, the sidewall structure having openings on opposite sides of the chamber, the rod attached at and extending through the openings and across the chamber.

7. The switch of claim 6, wherein the force transmission element is disposed in the chamber between the diaphragm and the rod such that pressure-induced deflection of the diaphragm into the chamber forces the force transmission element against the rod.

8. The switch of claim 6, wherein the force transmission element is attached to the interior side of the diaphragm and extends into the chamber and toward the rod such that pressure-induced deflection of the diaphragm puts the force transmission element in increasing transverse loading contact with the rod until the deflection is great enough to cause the force transmission element to load the rod beyond its breaking point, thereby severing the deposit of conductive material and opening the electrical path.

9. The switch of claim 6, wherein the force transmission element comprises a piston attached to the interior side of the diaphragm, the piston extending from the diaphragm to the rod, the piston being in minimal transverse loading contact with the rod under a condition of no pressure differential across the diaphragm, the diaphragm deflecting into the chamber as the pressure outside the chamber exceeds the pressure within the chamber, the deflection of the diaphragm forcing the piston against the rod thereby to increase the transverse loading of the rod beyond its breaking point, whereby the deposit of conductive material is severed and the electrical path opened.

10. The switch of claim 6, wherein the force transmission element is attached to and extends transversely from the rod and toward the diaphragm such that deflection of the diaphragm imparts a force through the force transmission element acting on the rod in a transverse direction of sufficient magnitude to break the rod.

11. The switch of claim 6, wherein the base comprises a hollow cylinder having the sidewall structure closed on one end and wherein the diaphragm sealingly covers the other end of the cylinder and wherein the rod extends diametrically through the sidewall structure, the ends of the rod forming externally accessible electrical terminals.

12. The switch of claim 6, wherein the rod is made of a ceramic material.

13. The switch of claim 6, wherein the rod is made of an inelastic material impregnated with a conductive material forming the continuous electrical path.

14. The switch of claim 6, wherein the rod is made of an inelastic material having a layer of conductive material deposited therealong to form the continuous electrical path.

15. The switch of claim 1, wherein the diaphragm comprises a domed portion deflatable by snap action between a first normally undeflected state and a second deflected state, the second state being reached when the pressure differential exceeds a preselected value.

16. The switch of claim 1, wherein the diaphragm deflects in a direction along a ling through the diaphragm and the conducting means by an amount proportional to the pressure differential.

17. The switch of claim 1, wherein the diaphragm is sealed along the edge to the base to form a sealed chamber having an internal pressure $P_1$ between the diaphragm and the base.

18. A pressure-actuated electrical switch, comprising:

a vessel having sidewall structure and an opening at one end;

a pressure-sensitive diaphragm sealed over the opening of the vessel to form a chamber sealed from the atmosphere and having an internal pressure $P_1$;

the sidewall structure forming a pair of holes therethrough on opposite sides of the sealed chamber;

a rod extending through the pair of holes and attached to the sidewall structure at the pair of holes, the rod extending across the sealed chamber;

the rod being made of a brittle material and including along its length a conductive path through the vessel;

a load transmission element in the chamber and attached to at least one of the diaphragm and the rod and positioned generally therebetween in the sealed chamber;

the diaphragm deflecting whenever the pressure $P_2$ external to the diaphragm differs from the internal pressure $P_1$ by more than a preselected value, the deflection of the diaphragm causing the load transmission element to impart a force to the rod of sufficient strength to snap the rod, thereby irreversibly breaking the conductive path through the vessel.

19. The switch of claim 18, wherein the load transmission element comprises a piston attached to the diaphragm and a tapered extension extending from the piston, the narrow end of the tapered extension contacting the rod and transmitting a transverse force at a point on the rod whenever the external pressure $P_2$ exceeds the internal pressure $P_1$ by more than a preselected value, the transverse force being sufficient to snap the rod.

20. The switch of claim 18, wherein the load transmission element comprises a ring having a bore accommodating the rod attached therethrough, the diaphragm deflecting into the chamber and into contact with the ring whenever the external pressure $P_2$ exceeds the internal pressure $P_1$ by more than a preselected value, the contact causing the ring to impart to the rod a transverse force sufficient to snap the rod.

21. The switch of claim 18, wherein the load transmission element comprises a ring having a circumferential edge and a bore accommodating the rod attached therethrough, the diaphragm being attached to the ring along a portion of the circumferential edge, the diaphragm deflecting outward from the chamber whenever the external pressure $P_2$ drops below the internal pressure $P_1$ by more than a preselected value, the outward deflection of the diaphragm causing the ring attached thereto to impart to the rod a transverse force sufficient to snap the rod.

22. A non-resettable, pressure-actuated electrical switch, comprising:

a hollow vessel having an open end;

frangible conducting means including a continuous electrical path transversing the hollow vessel;

a diaphragm sealed along an edge to the hollow vessel at the open end to form a chamber sealed from the atmosphere and having an internal pressure $P_1$, the diaphragm having an exterior side and an interior side forming a wall of the sealed chamber; and a force transmission element physically coupled to the interior side of the diaphragm;

the diaphragm responding to a preselected pressure differential across the diaphragm by deflecting and imparting a deflection force to the force transmission element to break the frangible conducting means and cause the electrical path to open irreversibly.

23. The switch of claim 22, wherein the diaphragm comprises a domed portion pressure-deflectable by snap action between a first normally undeflected state and a second deflected state, the domed portion snapping into the second deflected state and imparting a deflection force through the force transmission element to the frangible conducting means whenever the pressure $P_2$ external to the switch exceeds the internal pressure $P_1$ by a preselected value.

24. The switch of claim 22, wherein the hollow vessel further includes sidewall structure defining a pair of holes therethrough and wherein the frangible conducting means comprises a brittle rod attached at the pair of holes in the sidewall structure and traversing the sealed chamber, the ends of the rod extending outside of the sidewall structure to serve as electrical terminals of the continuous electrical path.

25. A non-resettable, pressure-sensitive switch, comprising:

a frangible base including a continuous electrical path;

a pair of externally-accessible electrical terminals on the base and connected at a pair of respective locations on the continuous electrical path; and a pressure-sensitive diaphragm having first and second sides bounded by an outer edge, the diaphragm being sealingly attached along the outer edge to the base to form a sealed chamber between the base and the first side of the diaphragm;

a force transmission element physically coupled between the base and the diaphragm;

the base further having a thin region intersecting the continuous electrical path between the pair of terminals;

the diaphragm deflecting from a normal position to a deflected position in response to a pressure differential from the first side to the second side of the diaphragm exceeding a preselected value;

the deflection of the diaphragm from the normal position to the deflected position imparting a deflection force to the force transmission element to transmit a stress to the thin region of the base at or above the fracture stress level of the thin region, causing the base to fracture in the thin region and break the electrical conducting path between the pair of terminals.

26. The switch of claim 25, wherein the frangible base further comprises a substrate of inelastic material having a grooved thin region intersected by a layer of conductive material deposited on the substrate and forming the continuous electrical path.

27. The switch of claim 26, wherein the frangible base is circular and the thin region lies along a first diametrical direction and the continuous electrical path lies along a second diametrical direction.

28. The switch of claim 26, wherein the frangible base is circular and the thin region lies along the circumference of a circle concentric with the base.

29. The switch of claim 25, wherein the frangible base further comprises a metallic layer deposited on a side thereof and wherein the diaphragm is sealingly attached at its outer edge to the metallic layer by a soldered connection.

30. The switch of claim 25, wherein the pressure-sensitive diaphragm comprises a domed snap disk operable by snap action between the normal position and the deflected position.

31. A non-resettable, pressure-actuated electrical switch, comprising:

a chamber sealed from the atmosphere and including a diaphragm having an interior side and an exterior side and defining a deflectable boundary between the inside of the chamber adjacent to the interior side of the diaphragm and the outside of the chamber adjacent to the exterior side of the diaphragm, the inside of the chamber having a pressure $P_1$ and the outside of the chamber having a pressure $P_2$ and the diaphragm deflecting in response to a pressure differential between $P_1$ and $P_2$;

a frangible element at least partially within said chamber;

a force transmission element physically coupled between the interior side of the diaphragm and the frangible element, the force transmission element transmitting the deflection force of the diaphragm to the frangible element, wherein the element breaks in response to a preselected pressure differential between $P_1$ and $P_2$; and an electrically conductive path arranged in contact with the frangible element to break irreversibly when the frangible element breaks.

* * * * *